US005948973A

United States Patent [19]

Fujii et al.

[11] Patent Number: 5,948,973

[45] Date of Patent: Sep. 7, 1999

[54] ENGINE-ROTATION DETECTING SYSTEM

[75] Inventors: Noriaki Fujii; Toshiyuki Sato; Mamoru Kosuge, all of Saitama, Japan

[73] Assignee: Honda Giken Kogyo Kabushiki Kaisha, Tokyo, Japan

[21] Appl. No.: 08/838,081

[22] Filed: Apr. 15, 1997

[30] Foreign Application Priority Data

Apr. 17, 1996 [JP] Japan ..... 8-095079

[51] Int. Cl.[6] ..... F02P 07/06; F01L 01/04

[52] U.S. Cl. ..... 73/116

[58] Field of Search ..... 73/116, 117.2, 73/117.3, 118.1

[56] References Cited

U.S. PATENT DOCUMENTS

| | | | |
|---|---|---|---|
| 4,932,388 | 6/1990 | Chiba et al. | 73/117.3 |
| 5,361,630 | 11/1994 | Kowalski | 73/117.3 |
| 5,548,995 | 8/1996 | Clinton et al. | 73/116 |
| 5,715,780 | 2/1998 | Haller | 123/90.17 |
| 5,747,679 | 5/1998 | Dietz et al. | 73/116 |

FOREIGN PATENT DOCUMENTS

| | | |
|---|---|---|
| 47-22275 | 7/1972 | Japan . |
| 61-184916 | 11/1986 | Japan . |
| 62-26566 | 2/1987 | Japan . |

*Primary Examiner*—George Dombroske

*Attorney, Agent, or Firm*—Carrier, Blackman & Associates, P.C.; Joseph P. Carrier; William D. Blackman

[57] ABSTRACT

A first thrust limiting member and a second thrust limiting member are provided on a cam shaft rotatably carried between a lower cam shaft holder and an upper cam shaft holder which are fixed to an upper surface of a cylinder head 1, so that the first and second thrust limiting members and abut against the cam shaft holders $\mathbf{9}_5$ and $\mathbf{10}_5$. The second thrust limiting member has a plurality of detected projections provided around of an outer periphery thereof, so that the detected projections are detected by a TDC sensor 37 mounted to a head cover of the engine. Thus, the rotated position (phase), the angle of rotation and the number of rotations of an rotary shaft of an engine such as a cam shaft 6*e* and a crankshaft can be detected with good accuracy in a structure including a decreased number of parts, and the axial dimension of the rotary shaft of the engine can be reduced.

22 Claims, 7 Drawing Sheets

ENGINE-ROTATION DETECTING SYSTEM

BACKGROUND OF THE INVENTION

1. Field of the Invention

The present invention relates to an engine-rotation detecting system including a detected portion provided on a rotary shaft of an engine, and a sensor for detecting the position of the detected portion.

2. Description of the Related Art

A detecting system for detecting a crank angle of an engine is conventionally known from Japanese Utility Model Application Laid-open No. 62-26566, which includes a detected portion projectingly provided on an outer periphery of a rotatable plate mounted on a crankshaft, and a sensor disposed in the vicinity of the rotatable plate for detecting the position of the detected portion.

In general, the rotatable plate for detecting the rotation is conventionally provided separately from a thrust limiting plate for limiting the axial movement of the rotary shaft of the engine, resulting in an increased number of parts due to the rotatable plate. In addition, the position of the rotatable plate is spaced apart from the position of the thrust limiting plate and for this reason, there is a possibility that the position of the rotatable plate may be varied by an influence of the thermal expansion of the rotary shaft or the like, resulting in a reduced detection accuracy of the sensor.

SUMMARY OF THE INVENTION

Accordingly, it is an object of the present invention to detect the rotated position (phase), the angle of rotation and the number of rotations of the rotary shaft of the engine such as a cam shaft and a crankshaft in a structure including a decreased number of parts, and to reduce the axial dimension of the rotary shaft of the engine.

To achieve the above object, according to a first aspect and feature of the present invention, there is provided an engine-rotation detecting system comprising a detected portion provided on a rotary shaft of an engine, and a sensor for detecting the position of the detected portion, wherein the detected portion is provided on a thrust limiting member mounted on the rotary shaft for limiting the axial movement of the rotary shaft.

With the above arrangement, the detected portion to be detected by the sensor is provided on the thrust limiting member mounted on the rotary shaft for limiting the axial movement of the rotary shaft. Therefore, a special member for provision of the detected portion is not required, leading to a decreased number of parts. Additionally, the axial dimension of the engine can be reduced and moreover, the position of the detected portion can be prevented from being axially displaced to enhance the detection accuracy.

The above and other objects, features and advantages of the invention will become apparent from the following description of the preferred embodiments taken in conjunction with the accompanying drawings.

BRIEF DESCRIPTION OF THE DRAWINGS

FIGS. 1 to 9 illustrate a presently preferred embodiment of the present invention, wherein FIG. 1 is a plan view illustrating a serial 4-cylinder engine in a state in which a head cover has been removed;

FIG. 2 is an enlarged view of an essential portion shown in FIG. 1;

FIG. 3 is a sectional view taken along a line 3—3 in FIG. 2;

FIG. 4 is a sectional view taken along a line 4—4 in FIG. 2;

FIG. 5 is a sectional view taken along a line 5—5 in FIG. 2;

FIG. 6 is a view (a top view of a lower cam shaft holder) taken along a line 6—6 in FIG. 5;

FIG. 7 is a view (a bottom view of the lower cam shaft holder) taken along a line 7—7 in FIG. 5;

FIG. 8 is a view taken in a direction of an arrow 8 in FIG. 5; and

FIG. 9 is a sectional view taken along a line 9—9 in FIG. 5.

DETAILED DESCRIPTION OF THE PREFERRED EMBODIMENT

The present invention will now be described by way of a particular embodiment with reference to FIGS. 1 to 9.

Figure 1:
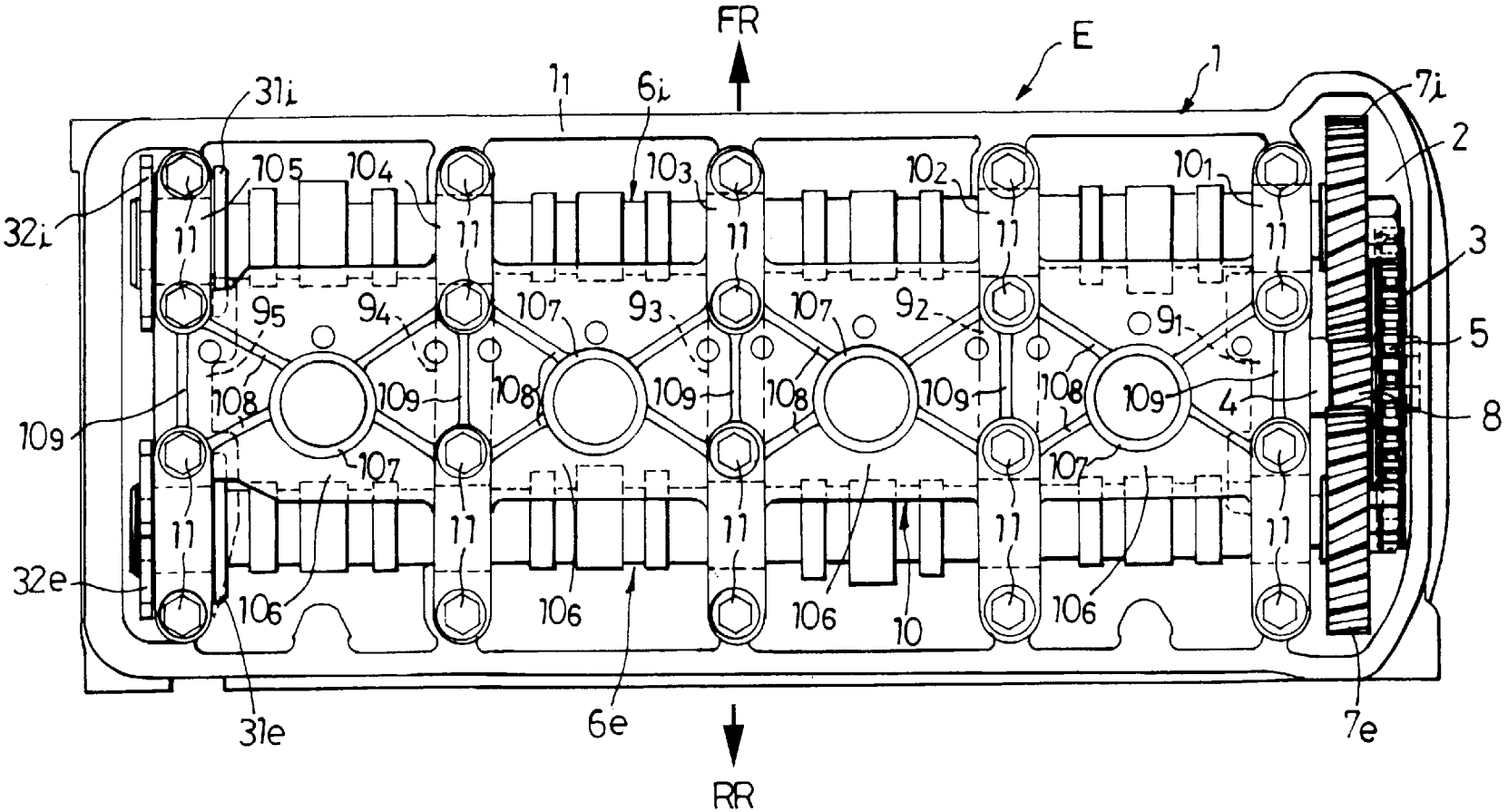

FIG. 1 is a plan view illustrating an in-line type 4-cylinder engine E in a state in which a head cover has been removed. In a state mounted to a vehicle body, the direction of an arrow FR is front (on an intake side), and the direction of an arrow RR is rear (on an exhaust side). A head cover coupling surface $\mathbf{1}_1$ is formed around an upper surface of a cylinder head 1 to which a lower surface of the head cover is coupled. A timing chain 3 for transmitting the rotation of a crankshaft (not shown) to a valve operating device is accommodated in a timing chain chamber 2 which is defined on one side (a right side of a vehicle) of the engine to vertically extend through the head cover coupling surface $\mathbf{1}_1$. A chain sprocket 5 is carried on an intermediate shaft 4 which is mounted in the cylinder head 1 to protrude into the timing chain chamber 2, and an upper end of the timing chain 3 is meshed with the chain sprocket 5.

An intake cam shaft **6*i* and an exhaust cam shaft 6*e* are carried in parallel to each other in the cylinder head 1, and follower helical gears 7*i* and 7*e* provided at right ends of the intake and exhaust cam shafts 6*i* and 6*e* are meshed with a driving helical gear 8 carried on the intermediate shaft 4. Thus, the rotation of the crankshaft is transmitted through the timing chain 3, the chain sprocket 5, the intermediate shaft 4, the driving helical gear 8 and the follower helical gears 7*i* and 7*e* to the intake and exhaust cam shafts 6*i* and 6*e* to drive the intake and exhaust cam shafts 6*i* and 6*e* at a number of revolutions one half of that of the crankshaft. At this time, a smooth transmission of power from the crankshaft to the intake and exhaust cam shafts 6*i* and 6*e* is achieved by meshing of the driving helical gear 8 with the follower helical gears 7*i* and 7*e*, but an axial large thrust load is applied to both of the intake and exhaust cam shafts 6*i* and 6*e***.

Five, #1, #2, #3, #4 and #5, lower cam shaft holders $\mathbf{9}_1$, $\mathbf{9}_2$, $\mathbf{9}_3$, $\mathbf{9}_4$ and $\mathbf{9}_5$ are juxtaposed in sequence from the right side to the left side of the vehicle body on an upper surface of the cylinder head 1. The intake and exhaust cam shafts **6*i* and 6*e* are rotatably carried between the lower cam shaft holders $\mathbf{9}_1$, $\mathbf{9}_2$, $\mathbf{9}_3$, $\mathbf{9}_4$ and $\mathbf{9}_5$ commonly fastened to the cylinder head 1 and an upper cam shaft holder assembly 10 by threadedly inserting a total of 20 bolts 11 passed through an assembly 10 of upper cam shaft holders integrally formed and the five lower cam shafts $\mathbf{9}_1$, $\mathbf{9}_2$, $\mathbf{9}_3$, $\mathbf{9}_4$ and $\mathbf{9}_5$ into the upper surface of the cylinder head 1**.

The upper cam shaft holder assembly 10 includes five upper cam shaft holders $\mathbf{10}_1$, $\mathbf{10}_2$, $\mathbf{10}_3$, $\mathbf{10}_4$ and $\mathbf{10}_5$ coupled to upper surfaces of the five lower cam shaft holders $\mathbf{9}_1$, $\mathbf{9}_2$, $\mathbf{9}_3$, $\mathbf{9}_4$ and $\mathbf{9}_5$, and four connecting portions $\mathbf{10}_6$ which integrally couple the five upper cam shaft holders $\mathbf{10}_1$, $\mathbf{10}_2$, $\mathbf{10}_3$, $\mathbf{10}_4$ and $\mathbf{10}_5$ to one another. Provided on an upper surface of each of the connecting portion $\mathbf{10}_6$ are a spark plug guide $\mathbf{10}_7$ for mounting and removing a spark plug (not shown) , reinforcing ribs $\mathbf{10}_8$, $\mathbf{10}_8$ formed so as to intersect each other in an X-shape, and a plurality of oil return bores $10_{10}$ for returning an oil accumulated on the upper surface of the connecting portion $10_6$ downwards. A reinforcing rib $10_9$ is provided on the upper surface of each of the upper cam shaft holders $10_1$, $10_2$, $10_3$, $10_4$ and $10_5$ to extend in a direction perpendicular to axes of the intake and exhaust cam shafts 6*i* and 6*e*.

Figure 2:
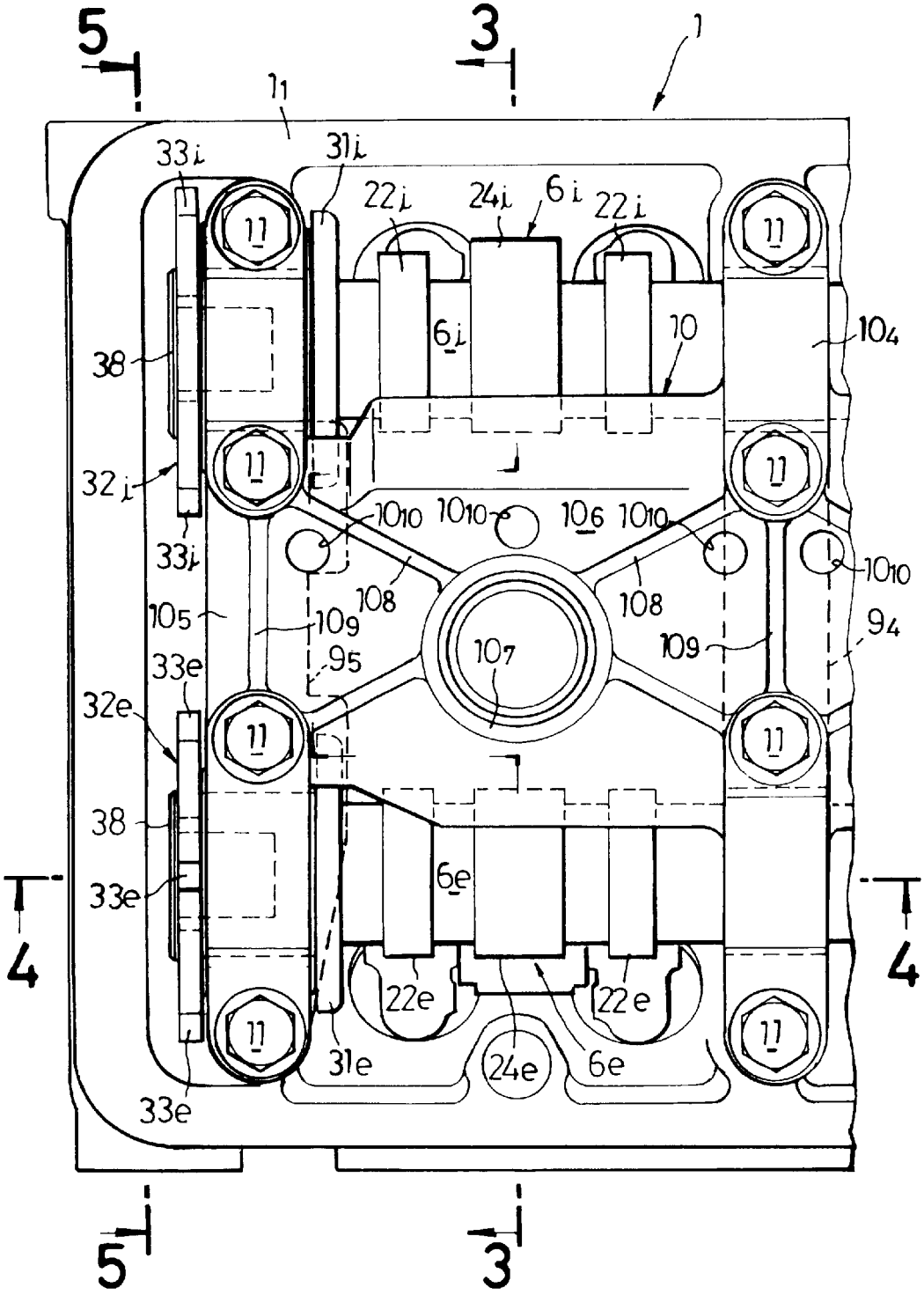
Figure 3:
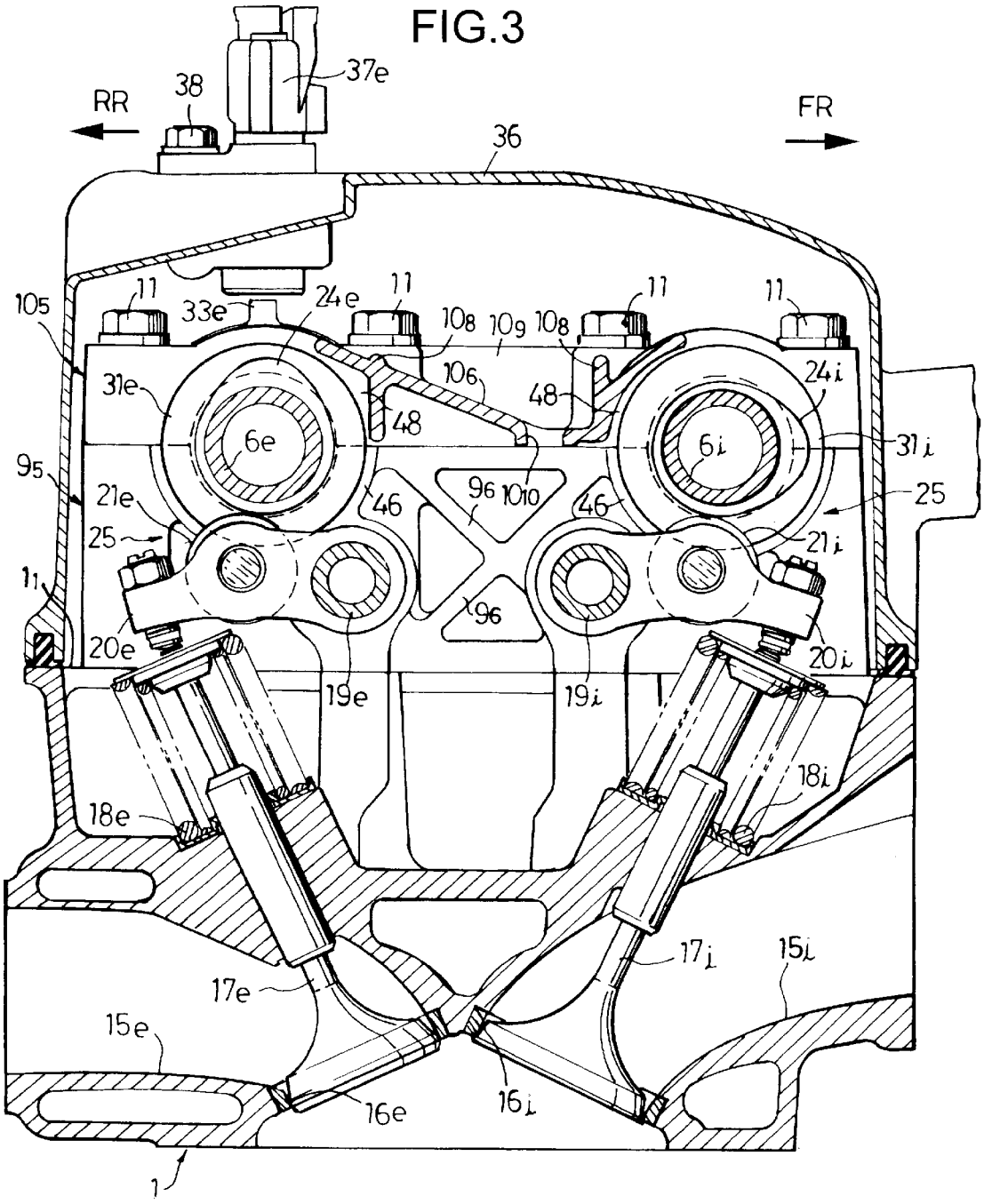
Figure 4:
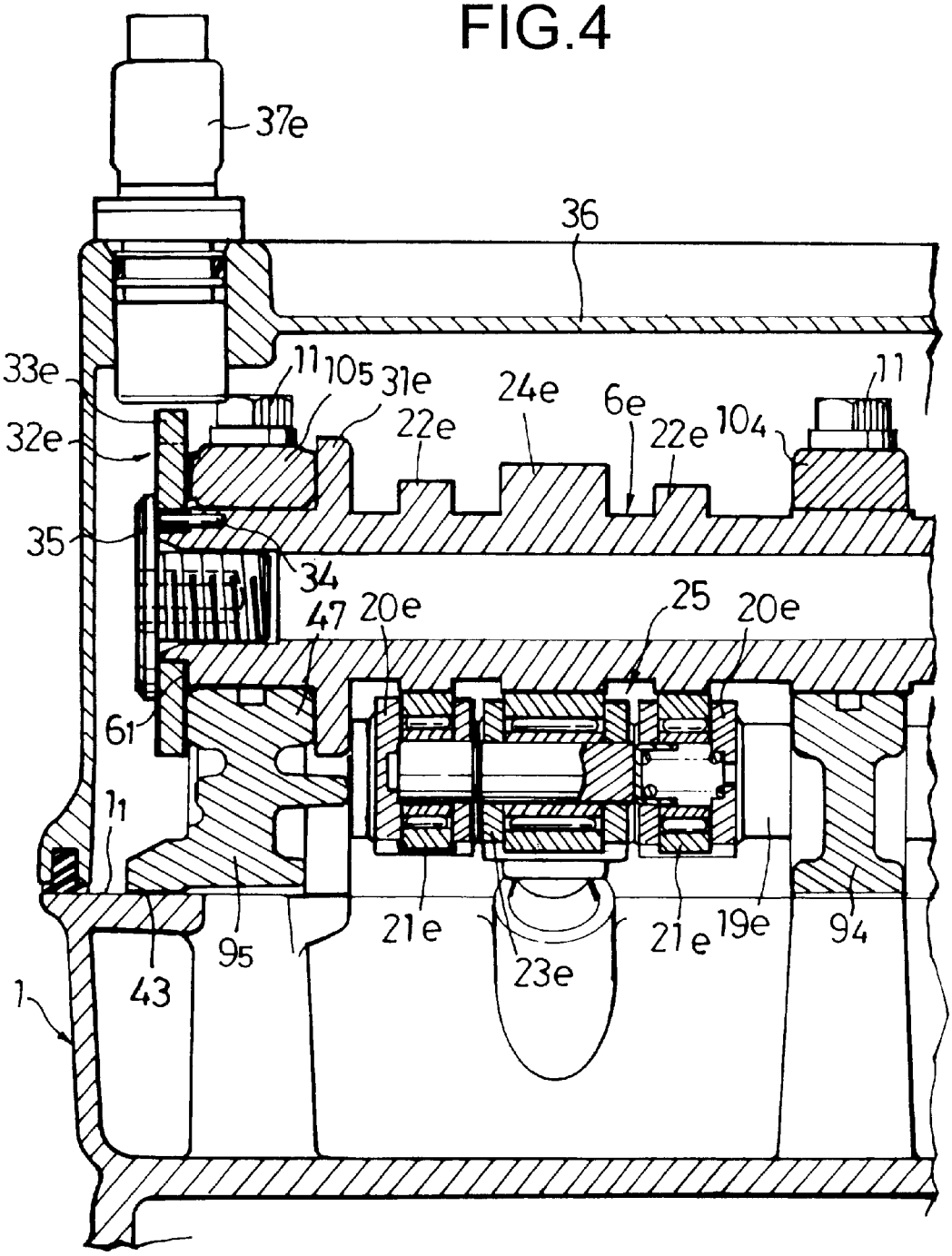

As can be seen from FIGS. 2 to 4, an intake port 15*i* and an exhaust port 15*e* are provided in the cylinder head 1 in correspondence to each of cylinders. Valve bores 16*i*, 16*i*; 16*e*, 16*e* are connected to the intake and exhaust ports 15*i* and 15*e* and opened and closed by a pair of intake valves 17*i*, 17*i* and a pair of exhaust valves 17*e*, 17*e*, respectively. The intake valves 17*i*, 17*i* and the exhaust valves 17*e*, 17*e* are biased in closing directions by valve springs 18*i*, 18*i*; 18*e*, 18*e*, respectively.

An intake rocker shaft 19*i* and an exhaust rocker shaft 19*e* are supported on the five lower cam shaft holders $9_1$, $9_2$, $9_3$, $9_4$ and $9_5$. A pair of intake rocker arms 20*i*, 20*i*are pivotally supported at one ends thereof on the intake rocker shaft 19*i*, with the other ends of the intake rocker arms 20*i*, 20*i* abutting against stem ends of the intake valves 17*i*, 17*i*. A pair of exhaust rocker arms 20*e*, 20*e* are pivotally supported at one ends thereof on the exhaust rocker shaft 19*e*, with the other ends of the exhaust rocker arms 20*e*, 20*e* abutting against stem ends of the exhaust valves 17*e*, 17*e*. Rollers 21*i*, 21*i* are provided at intermediate portions of the lower-speed intake rocker arms 20*i*, 20*i* and abut against lower-speed cams 22*i*, 22*i* provided on the intake cam shaft 6*i*. Rollers 21*e*, 21*e* are provided at intermediate portions of the lower-speed exhaust rocker arms 20*e*, 20*e* and abut against lower-speed cams 22*e*, 22*e* provided on the exhaust cam shaft 6*e*.

An exhaust-side valve operating mechanism including the exhaust rocker shaft 19*e* is shown in FIG. 4. As can be seen from FIG. 4, a high-speed exhaust rocker arm 23*e* is pivotally supported on the exhaust rocker shaft 19*e*, so that it is sandwiched between the pair of lower-speed exhaust rocker arms 20*e*, 20*e*. The high-speed exhaust rocker arm 23*e* abuts against a high-speed cam 24*e* provided on the exhaust cam shaft 6*e*. The high-speed exhaust rocker arm 23*e* and the lower-speed exhaust rocker arms 20*e*, 20*e* are capable of being connected to and disconnected from each other by a variable valve timing/lifting mechanism 25. The structure of the variable valve timing/lifting mechanism 25 is know and is not described herein in detail. The structure of an intake-side valve operating mechanism is substantially the same as that of the above-described exhaust-side valve operating mechanism.

Thus, during operation of the engine E at a high speed, the high-speed rocker arms 23*i* and 23*e* are coupled to the low-speed rocker arms 20*i*, 20*i*; 20*e*, 20*e* by the variable valve timing/lifting mechanism 25, and the intake valves 17*i*, 17*i* and the exhaust valves 17*e*, 17*e* are driven by profiles of the high-speed cams 24*i* and 24*e*. During operation of the engine E at a low speed, the high-speed rocker arms 23*i* and 23*e* are disengaged from the low-speed rocker arms 20*i*, 20*i*;20*e*, 20*e* by the variable valve timing/lifting mechanism 25, and the intake valves 17*i*, 17*i* and the exhaust valves 17*e*, 17*e* are driven by profiles of the low-speed cams 22*i*, 22*i*; 22*e*, 22*e*.

Figure 5:
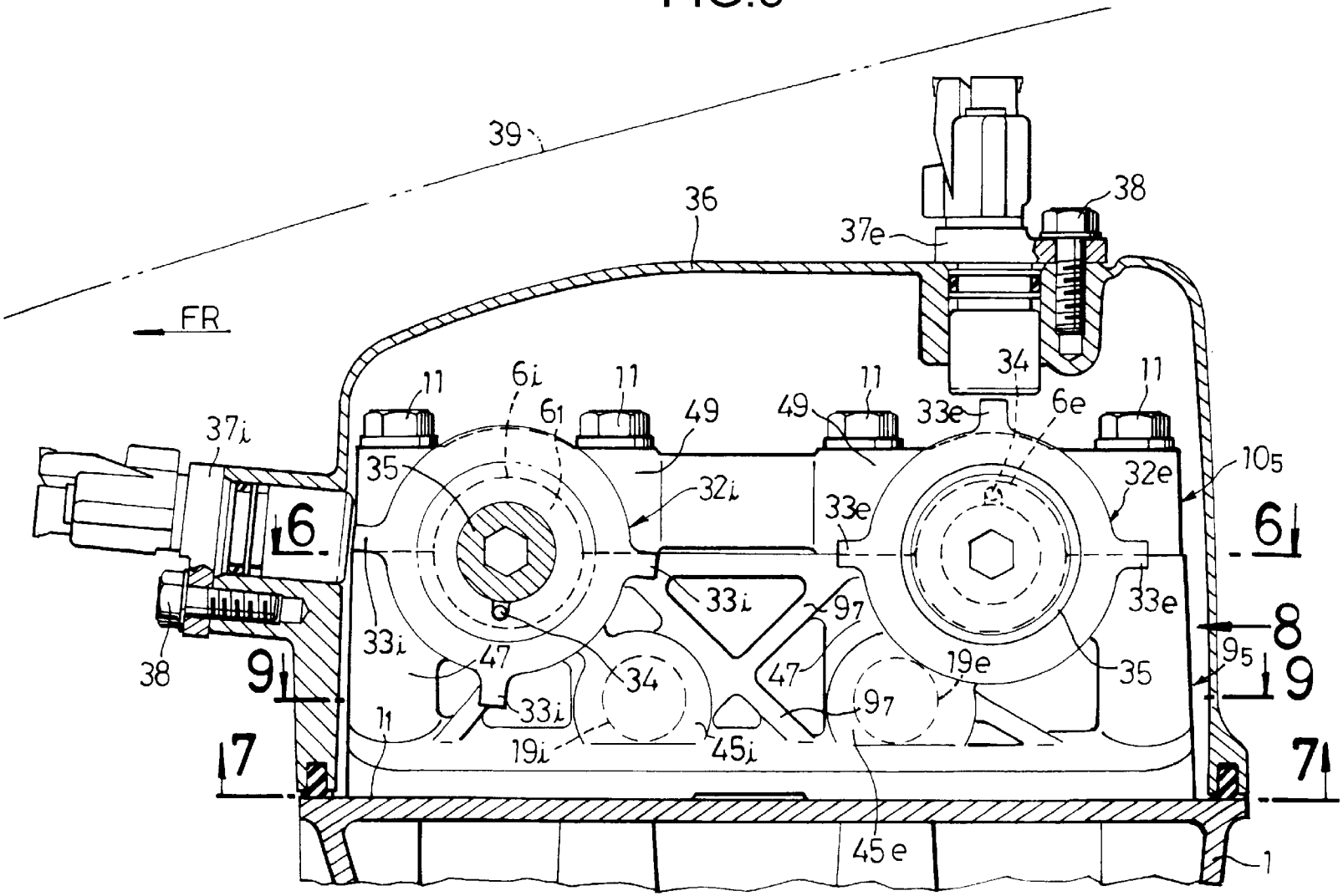
Figure 6:
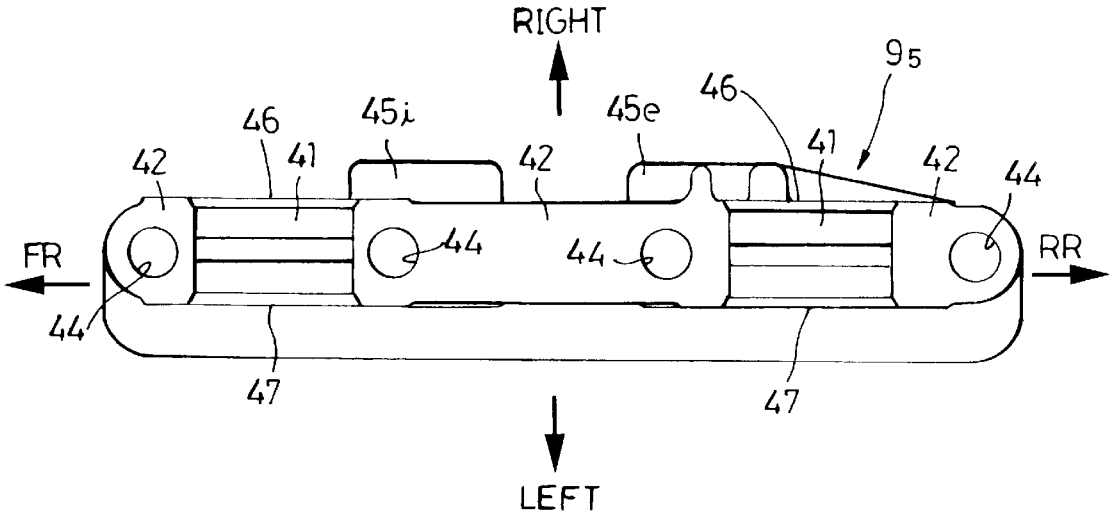
Figure 7:
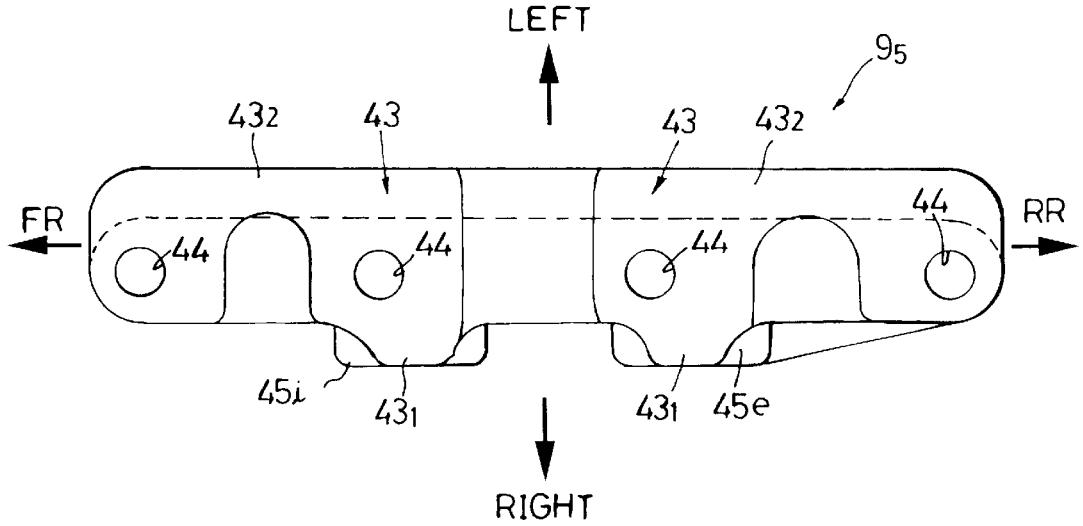
Figure 8:
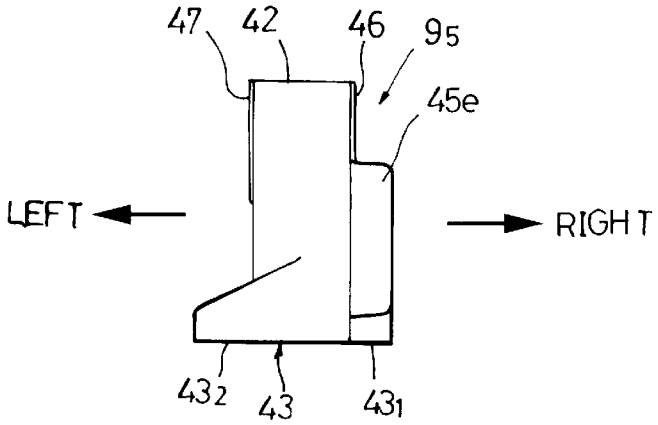
Figure 9:
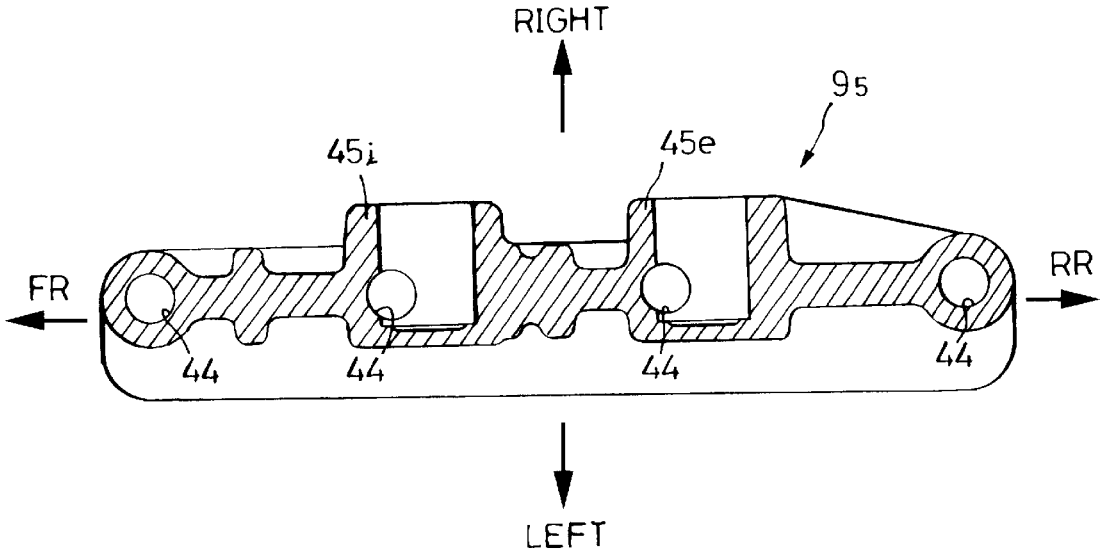

As shown in FIGS. 2, 4 and 5, first thrust limiting members 31*i* and 31*e* and second thrust limiting members 32*i* and 32*e* are mounted at left axial ends of the intake and exhaust cam shafts 6*i* and 6*e*. Each of the first thrust limiting members 31*i* and 31*e* is a disk-like member and integrally formed on each of the intake and exhaust cam shafts 6*i* and 6*e*. On the other hand, each of the second thrust limiting members 32*i* and 32*e* is a substantially disk-like member having three detected projections 33*i*, 33*e* spaced at distances of 90° from each other on an outer periphery thereof, respectively, and is fitted into a stepped portion $6_1$, $6_1$ (see FIGS. 4 and 5) at an axial end of each of the intake and exhaust cam shafts 6*i* and 6*e* and fixed by a bolt 35, 35 in a state in which it has been positioned in a rotating direction by a positioning pin 34, 34.

Fixed to the head cover 36 coupled to the upper surface of the cylinder head 1 by bolts 38, 38 are a TDC (a top dead center of a piston)sensor 37*i* for detecting the three detected projections 33*i* of the second thrust limiting member 32*i* on the side of the intake cam shaft 6*i*, and a TDC sensor 37*e* for detecting the three detected projections 33*e* of the second thrust limiting member 32*e* on the side of the exhaust cam shaft 6*e*. The TDC sensors 37*i* and 37*e* are disposed in radiate directions with respect to the cam shafts 6*i* and 6*e*, respectively, and in planes of rotation of the second thrust limiting members 32*i* and 32*e* in order to shorten the axial dimension of the engine E.

As can be seen from FIG. 5, a bonnet 39 covering an upper portion of the engine E is inclined downwards toward the forward direction, so that the front side (intake side) is lower and the rear side (exhaust side) is higher. The interference of the TDC sensors 37*i* and 37*e* with the bonnet 39 can be avoided while suppressing the gap between the head cover 36 and the bonnet 39 to the minimum by supporting the TDC sensor 37*i* on the side of the intake cam shaft 6*i* substantially horizontally on the front surface of the head cover 36 and supporting the TDC sensor 37*e* on the side of the exhaust cam shaft 6*e* substantially vertically on the upper surface of a rear portion of the head cover 36.

Thus, the passage of each of the three detected projections 33*i*, 33*e* of the second thrust limiting members 32*i* and 32*e* can be detected by the TDC sensors 37*i* and 37*e*, and TDC of the four cylinders can be detected based on a timing of the detection of such passage.

The structure of the #5 lower cam shaft holder $9_5$ disposed between the first thrust limiting members 31*i* and 31*e* and the second thrust limiting members 32*i* and 32*e* will be described below mainly with reference to FIGS. 6 to 9.

Three upper cam shaft holder coupling surfaces 42 are formed on an upper surface of the #5 lower cam shaft holder $9_5$ and separated from one another by a pair of semi-circular cam shaft support portions 41, 41 which support the cam shafts 6*i* and 6*e*, and two cylinder head coupling surfaces 43, 43 are formed on a lower surface of the #5 lower cam shaft holder $9_5$ and separated from each other at a central point of such lower surface. Four bolt bores 44 are provided in the upper cam shaft holder coupling 5 surfaces 42 and the cylinder head coupling surfaces 43 to extend through these surfaces 42 and 43, and the bolts 11 are passed through the bolt bores 44.

Two rocker shaft-supporting boss portions 45*i* and 45*e* are projectingly provided on a right side (i.e., a side on the side of the #4 lower rocker shaft holder $9_4$) of the #5 lower cam shaft holder $9_5$, and the intake-side rocker arm 19*i* and the exhaust-side rocker arm 19*e* are supported in fitted states on the rocker shaft supporting boss portions 45*i* and 45*e*. A pair of protrusions $43_1$, $43_1$ connected to the cylinder head coupling surfaces 43, 43 are formed by extension of the pair of rocker shaft supporting boss portions 45*i* and 45*e* to the cylinder head coupling surfaces 43, 43. A pair of protrusions $43_2$, $43_2$ connected to the cylinder head coupling surfaces 43, 43 are integrally formed at a lower portion of a left side (i.e., a side on the opposite side from the #4 lower rocker shaft holder $9_4$) of the #5 lower cam shaft holder $9_5$.

First thrust load supporting surfaces 46, 46 are formed on the right side of the #5 lower cam shaft holder $9_5$ to surround the cam shaft supporting portions 41, 41, and the first thrust limiting members 31*i* and 31*e* are in sliding contact with the first thrust load supporting surfaces 46, 46. Second thrust load supporting surfaces 47, 47 are formed on the left side of the #5 lower cam shaft holder $\mathbf{9}_5$ to surround the cam shaft supporting portions 41, 41, and the second thrust limiting members 32*i* and 32*e* are in sliding contact with the second thrust load supporting surfaces 47, 47. The #5 upper cam shaft holder $\mathbf{10}_5$ similarly has first and second thrust load supporting surfaces 48,48; 49,49 as shown in FIGS. 3 and 5.

As can be seen from FIG. 3, reinforcing ribs $\mathbf{9}_6$, $\mathbf{9}_6$ intersecting each other in an X-shape are formed on the right side of the #5 lower cam shaft holder $\mathbf{9}_5$ to connect the pair of cam shaft supporting portions 41, 41 and the pair of rocker shaft supporting boss portions 45*i* and 45*e* to each other. Reinforcing ribs $\mathbf{9}_7$, $\mathbf{9}_7$ mirror-symmetrical with the reinforcing ribs $\mathbf{9}_6$, $\mathbf{9}_6$ are also formed on the left side of the #5 lower cam shaft holder $\mathbf{9}_5$ (see FIG. 5). Thus, by fastening the reinforcing ribs $\mathbf{9}_6$, $\mathbf{9}_6$, $\mathbf{9}_7$, $\mathbf{9}_7$ at points having a higher rigidity in the vicinity of their ends with the bolts 11, a large fastening force can be applied to the bolts 11 to further enhance the rigidity of the #5 upper and lower cam shaft holders $\mathbf{10}_5$ and $\mathbf{9}_5$. Moreover, the rigidity of the thrust load supporting surfaces 46, 46; 47, 47; 48, 48; 49, 49 and the rocker shaft supporting boss portions 45*i* and 45*e* can be also enhanced.

When the intake and exhaust cam shafts 6*i* and 6*e* have received a thrust load due to the meshing of the driving helical gear 8 with the follower helical gears 7*i* and 7*e*, the thrust load is supported to limit the axial movements of the cam shafts 6*i* and 6*e* by the abutment of the first thrust limiting members 31*i* and 31*e* against the first thrust load supporting surfaces 46, 46; 48, 48 (see FIG. 3) formed on the right sides of the #5 lower cam shaft holder $\mathbf{9}_5$ and the #5 upper cam shaft holder $\mathbf{10}_5$, or by the abutment of the second thrust limiting members 32*i* and 32*e* against the second thrust load supporting surfaces 47, 47; 49, 49 (see FIG. 5) formed on the left sides of the #5 lower cam shaft holder $\mathbf{9}_5$ and the #5 upper cam shaft holder $\mathbf{10}_5$.

In this case, since the detected projections 33*i* and 33*e* adapted to be detected by the TDC sensors 37*i* and 37*e* are formed on the outer peripheries of the second thrust limiting members 32*i* and 32*e*, the conventional need for provision of a special rotatable plate having a detected projection is eliminated, leading to a reduction in number of parts. Moreover, since the detected projections 33*i* and 33*e* are provided on the second thrust limiting members 32*i* and 32*e* which limit the axial movements of the cam shafts 6*i* and 6*e*, the stable rotation of the detected projections 33*i* and 33*e* can be ensured, and the variation in axial position of the detected projections 33*i* and 33*e* caused due to an influence of the thermal expansion of the cam shafts 6*i* and 6*e* can be suppressed to the minimum to prevent a reduction in detecting accuracy of the TDC sensors 37*i* and 37*e* and to enhance the degree of freedom of the layout of the TDC sensors 37*i* and 37*e*. Further, since the thrust load supporting surfaces 46, 46, 47, 47 are formed adjacent the cam shaft supporting portions 41, 41 of the #5 lower cam shaft holder 95, the variation in rotation of the detected projections 33*i* and 33*e* can be further effectively prevented to enhance the detecting accuracy of the TDC sensors 37*i* and 37*e*.

When a thrust load from the cam shafts 6*i* and 6*e* has been applied to the #5 lower and upper cam shaft holders $\mathbf{9}_5$ and $\mathbf{10}_5$, the axial movement of the #5 lower cam shaft holder $\mathbf{9}_5$ can be prevented to further reliably support the cam shafts 6*i* and 6*e* to enhance the detecting accuracy of the TDC sensors 37*i* and 37*e* by the fact that the protrusions $\mathbf{43}_1$, $\mathbf{43}_1$; $\mathbf{43}_2$, $\mathbf{43}_2$ projecting axially of the cam shafts 6*i* and 6*e* are formed on the cylinder head coupling surface 43 of the #5 lower cam shaft holder $\mathbf{9}_5$. Moreover, since the protrusions $\mathbf{43}_1$, $\mathbf{43}_1$ are connected to the rocker shaft supporting boss portions 45*i* and 45*e*, the support rigidity of the rocker shaft 19*i* and 19*e* is also enhanced.

Further, since the #1 to #5 upper cam shaft holders $\mathbf{10}_1$ to $\mathbf{10}_5$ are integrally coupled to one another by the connecting portions $\mathbf{10}_6$, the thrust load applied to the upper cam shaft holder $\mathbf{10}_5$ can be dispersed to the #1 to #4 lower cam holders $\mathbf{9}_1$ to $\mathbf{9}_4$ through the #1 to #4 upper cam holders $\mathbf{10}_1$ to $\mathbf{10}_4$ to further effectively prevent the axial movement of the #5 upper cam shaft holder $\mathbf{10}_5$ and the #5 lower cam shaft holder $\mathbf{9}_5$.

Yet further, since the detected projections 33*i* and 33*e* are provided on those thrust limiting members 32*i* and 32*e* of the first and second thrust limiting members 31*i*, 31*e*, 32*i* and 32*e* sandwiching the #5 lower and upper cam shaft holders $\mathbf{9}_5$ and $\mathbf{10}_5$, which are located at the axial ends of the cam shafts 6*i* and 6*e* and above which there is not the connecting portion $\mathbf{10}_6$ of the upper cam shaft holder assembly 10, the detected projections 33*i* and 33*e* cannot interfere with the connecting portions $\mathbf{10}_6$, even if the height of the connecting portion $\mathbf{10}_6$ from the upper surface of the #5 lower cam shaft holder $\mathbf{9}_5$ is decreased to reduce the vertical dimension of the engine E. Thus, the size of the second thrust limiting members 32*i* and 32*e* having the detected projections 33*i* and 33*e* can be increased without increasing the size of the engine E to enhance the detecting accuracy.

Although the presently preferred embodiment of the present invention has been described in detail, it will be understood that the present invention is not limited to the above-described embodiment, and that various modifications may be made thereto without departing from the spirit and scope of the invention defined in the claims appended hereinbelow.

For example, the engine rotation detecting system according to the present invention is not limited to the use for the detection of the rotated position of the phase of the cam shafts 6*i* and 6*e* described above, but is also applicable to the detection of the rotated position, the rotational angle and the number of rotations of the rotary shaft (the crankshaft or the like) of the engine other than the cam shafts 6*i* and 6*e*. Although the detected projections 33*i*, 32*e* are provided on the thrust limiting members 32*i*, 32*e* formed separate from the cam shafts 6*i* and 6*e* in the embodiment, they may be provided on thrust limiting members formed integral with the cam shaft 6*i* and 6*e*.

What is claimed is:

1. An engine-rotation detecting system comprising a detected portion provided on a rotary shaft of an engine, and a sensor for detecting a position of said detected portion, wherein said detected portion is provided on a thrust limiting member mounted on said rotary shaft for limiting axial movement of said rotary shaft and for suppressing axial displacement of said detected portion.

2. An engine-rotation detecting system according to claim 1, wherein said rotary shaft is a cam shaft supported between an upper cam shaft holder and a lower cam shaft holder mounted on a cylinder head, said lower cam shaft holder being formed with an abutment portion against which said thrust limiting member abuts, and said lower cam shaft holder having a cylinder head coupling surface which is formed with a protrusion projecting axially of said cam shaft.

3. An engine-rotation detecting system according to claim 2, wherein said cam shaft is supported between a plurality of upper cam shaft holders and a plurality of lower cam shaft holders mounted on said cylinder head, said upper cam shaft holders being connected to one another by connecting portions extending in an axial direction of said cam shaft, said engine including a second thrust limiting member on said cam shaft and the two thrust limiting members are disposed on opposite sides of an end one of said lower cam shaft holders relative to said axial direction, said detected portion being provided on the outer periphery of an outermost one of said two thrust limiting members.

4. An engine-rotation detecting system according to claim 1, wherein said rotary shaft is a cam shaft supported between a plurality of upper cam shaft holders and a plurality of lower cam shaft holders mounted on a cylinder head, said upper cam shaft holders being connected to one another by connecting portions extending in an axial direction of said cam shaft, said engine including a second thrust limiting member on said cam shaft and the two thrust limiting members are disposed on opposite sides of an end one of said lower cam shaft holders relative to said axial direction, said detected portion being provided on the outer periphery of an outermost one of said two thrust limiting members which is located adjacent said end.

5. An engine-rotation detecting system according to claim 1, wherein said rotary shaft is a cam shaft supported on a cam shaft holder, said engine including a second thrust limiting member on said cam shaft and the two thrust limiting members are disposed on opposite sides of the cam shaft holder, which is provided near an end of said cam shaft in said axial direction, said detected portion being provided on one of said two thrust limiting members which is located adjacent said end of the cam shaft, and said sensor being mounted at a location opposed to said detected portion.

6. An engine-rotation detecting system according to claim 5, wherein one of said two thrust limiting members which is located axially inward of said end of the cam shaft is formed integrally with said cam shaft, and the other of said thrust limiting members is formed separately from said cam shaft.

7. An engine-rotation detecting system according to claim 5, wherein an opposite end of said cam shaft has a driving mechanism for said cam shaft connected thereto.

8. An engine-rotation detecting system according to claim 5, wherein said thrust limiting member having said detected portion provided thereon is non-rotatably fixed to the axial end of the cam shaft by a bolt and a positioning pin.

9. An engine-rotation detecting system according to claim 6, wherein said thrust limiting member having said detected portion provided thereon is non-rotatably fixed to the axial end of the cam shaft by a bolt and a positioning pin.

10. An engine-rotation detecting system according to claim 2, wherein said protrusion comprises a rocker shaft supporting boss portion of the lower cam shaft holder extended downwards to said cylinder head coupling surface.

11. An engine-rotation detecting system according to claim 3, wherein each said connecting portion has a plug guide formed at its central portion for attaching and detaching a spark plug.

12. An engine-rotation detecting system according to claim 11, further including ribs formed to extend radially from said plug guides toward cam holder fastening portions of said upper cam shaft holders.

13. An engine-rotation detecting system according to claim 1, wherein said sensor is mounted to a head cover of the engine.

14. An engine-rotation detecting system comprising detected portions provided on thrust limiting members for limiting the axial movement of two cam shafts of an engine and for suppressing axial displacement of said detected portions, and sensors for detecting positions of said detected portions, wherein each of said two cam shafts has a cam shaft-driving mechanism provided axially at one end thereof, and said detected portion provided at the other end thereof.

15. An engine-rotation detecting system according to claim 14, wherein said sensors are mounted to a head cover of the engine.

16. An engine-rotation detecting system for an engine having a rotary shaft and a thrust limiting member fixed to the rotary shaft for limiting axial movement thereof, the system comprising:

a detected portion of said thrust limiting member projecting radially from an outer periphery thereof; and sensing means disposed with said engine for sensing rotational movement of said detected portion;

said thrust limiting member also suppressing axial displacement of said detected portion.

17. An engine-rotation detection system according to claim 16, wherein:

said rotary shaft is a cam shaft, said thrust limiting member is fixed near one end of said cam shaft, and said engine further includes driving means disposed at an opposite end of the cam shaft for driving the cam shaft.

18. An engine-rotation detection system according to claim 16, wherein:

said rotary shaft is a cam shaft, said engine further includes a cam shaft holder mounted on a cylinder head for supporting the cam shaft, the cam shaft holder having an abutment portion against which the thrust limiting member abuts and a cylinder head coupling surface which is formed with a protrusion projecting axially of said cam shaft.

19. An engine-rotation detection system according to claim 16, wherein:

said rotary shaft is a cam shaft, said engine further includes a cam shaft holder mounted on a cylinder head for supporting the cam shaft and a second thrust limiting member on the cam shaft, the two thrust limiting members are disposed on opposite sides of the cam shaft holder near an axial end of the cam shaft, and the thrust limiting member with said detected portion is disposed on one said side of the cam shaft holder closest to said axial end of the cam shaft.

20. An engine-rotation detection system according to claim 16, wherein:

said thrust limiting member is fixed to an axial end of said rotary shaft and said sensing means includes a sensor mounted to a head cover of the engine.

21. An engine-rotation detecting system according to claim 1, wherein said detected portion projects in a radial direction from an outer periphery of the thrust limiting member.

22. An engine-rotation detecting system according to claim 14, wherein said detected portions project in a radial direction from an outer periphery of the thrust limiting member.

* * * * *

UNITED STATES PATENT AND TRADEMARK OFFICE

CERTIFICATE OF CORRECTION

PATENT NO : 5,948,973

DATED : 07 September 1999

INVENTOR(S) : Noriaki Fujii, Toshiyuki Sato, Mamoru Kosuge

It is certified that error appears in the above-identified patent and that said Letters Patent is hereby corrected as shown below:

On the cover page, in the "ABSTRACT", 5th-6th lines, change "and abut" to --abut--;
8th line, change "around of" to --on--;
12th line, change "an rotary" to --a rotary--.

Column 3, line numbered 18, change "one ends" to --one end--;
line numbered 22, change "one ends" to --one end--;
line 43, change "is know" to --is known--.

Column 4, line 46, delete "5".

Column 5, line 53, change "95" to --$\mathbf{9_5}$--.

Column 6, line numbered between 35 and 36, change "**32*e*" to --33*e***--.

Signed and Sealed this

Twenty-ninth Day of February, 2000

*Attest:*

*Attesting Officer*

Q. TODD DICKINSON

*Commissioner of Patents and Trademarks*